United States Patent [19]

Baker

[11] 4,216,114

[45] Aug. 5, 1980

[54] DEMULSIFICATION PROCESS

[75] Inventor: Alan S. Baker, Slough, England

[73] Assignee: Imperial Chemical Industries Limited, London, England

[21] Appl. No.: 955,604

[22] Filed: Oct. 30, 1978

[30] Foreign Application Priority Data

Nov. 18, 1977 [GB] United Kingdom ..... 48086/77

[51] Int. Cl.[2] ..... B01D 17/04

[52] U.S. Cl. ..... 252/341; 560/198; 252/340

[58] Field of Search ..... 252/340, 341; 560/198

[56] References Cited

U.S. PATENT DOCUMENTS

| | | | |
|---|---|---|---|
| 2,562,878 | 8/1951 | Blair, Jr. | 252/340 X |
| 2,993,773 | 7/1961 | Stromberg | 52/0.5 |
| 3,045,042 | 7/1962 | Staker | 260/485 |
| 3,057,890 | 10/1962 | DeGroote | 260/407 |
| 3,117,091 | 1/1964 | Staker | 560/198 X |
| 3,255,108 | 6/1966 | Wiese | 252/32.7 |
| 4,031,118 | 6/1977 | Miller | 560/198 X |

FOREIGN PATENT DOCUMENTS 1055337 1/1967 United Kingdom .

*Primary Examiner*—Benjamin R. Padgett
*Assistant Examiner*—J. Lloyd Barr
*Attorney, Agent, or Firm*—Cushman, Darby & Cushman

[57] ABSTRACT

Demulsification of a water-in-oil, especially a water-in-crude oil, emulsion is effected by contacting it with a polyester obtained by condensation of a $C_{9-18}$ alk(en)yl succinic anhydride, a water-soluble polyalkylene glycol of mol. wt. less than 500, and a polyhydric alcohol having three or more OH groups.

11 Claims, No Drawings

DEMULSIFICATION PROCESS

This invention relates to a method for the demulsification of water-in-oil emulsions, in particular of emulsions of water in crude petroleum.

According to the present invention there is provided a method for the demulsification of a water-in-oil emulsion which comprises contacting the emulsion with a polyester obtained by the condensation of:

(A) an alk(en)ylsuccinic anhydride of the formula

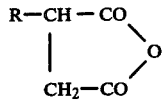

where R is an alkyl or alkenyl radical containing from 9 to 18 carbon atoms;

(B) a polyalkylene glycol which has an average molecular weight of less than 500 and is soluble in water to the extent of at least 5% by weight at 25° C.;

(C) a polyhydric alcohol having three or more hydroxyl groups capable of reacting with the anhydride (A); the polyester so obtained containing 20–40% by weight of residues of the polyalkylene glycol (B) and at least 1% by weight of residues of the polyhydric alcohol (C).

The alk(en)yl succinic anhydrides (A) which are used in making the polyesters hereinabove defined are known commercial materials. By an addition reaction between a monoolefin and maleic anhydride at an elevated temperature, usually in the presence of a catalyst such as a halogen, those members of the class are obtained in which the group R as depicted in the above formula is an alkenyl group; those members of the class in which R is an alkyl group can be made by subsequent hydrogenation of the alkenyl compounds. Suitable monoolefins are those containing from 9 to 18 carbon atoms, including nonene, decene, dodecene and octadecene; either straight-chain or branched-chain monoolefins may be used. A preferred alk(en)ylsuccinic anhydride is dodecenylsuccinic anhydride.

In making the polyesters, there may be used either a single alk(en)ylsuccinic anhydride or a mixture of two or more different such compounds.

The polyalkylene glycol (B) which is used in making the polyesters may be, for example, a polyethylene glycol, a mixed poly(ethylene-propylene) glycol or a mixed poly(ethylene-butylene) glycol, provided that it satisfies the molecular weight and water-solubility requirements hereinabove stated. In order for the polyalkylene glycol to have the requisite water solubility, it will normally be necessary for it to contain at least a major proportion of oxyethylene repeat units. The polyalkylene glycols are also commercially available materials, and a single such compound or a mixture of two or more such compounds differing in composition and/or molecular weight may be used.

Preferred polyalkylene glycols are polyethylene glycols of average molecular weight less than 500.

The polyhydric alcohol which is used in making the polyester may be any of the wide variety of such compounds which is known for use as constituents of polyesters or alkyd resins, for example glycerol, trimethylolpropane, trimethylolethane, hexanetriol, pentaerythritol, dipentaerythritol or sorbitol.

One or more than one polyhydric alcohol may be used, as desired.

The relative proportions of the three constituents (A), (B) and (C) which are used in making the polyester are chosen in accordance with the principles which are well known in the polyester and alkyd resin art, provided that the above-stated requirements as to the content in the polyester of residues of (B) and (C) are satisfied. In general, the proportions are chosen so as to approach a stoichiometric balance between the carboxyl groups derived from the anhydride (A) and the hydroxyl groups supplied by the constituents (B) and (C). Preferably this balance, and/or the degree to which the constituents are condensed together, are chosen so that the polyester has an acid value of less than 50 mg KOH/g., more preferably of less than 25 mg KOH/g. It is also preferred that the polyester should have a viscosity of at least 2 poise when measured at 25° C. as a 75% solids solution in xylene; this preference may be achieved by suitable choice of the proportion of the total hydroxylic constituents which is provided by the polyhydric alcohol (C) and/or of the degree of condensation of the reaction mixture.

There may if desired be included, in addition to the constituents (A), (B) and (C) described above, a monobasic fatty acid such as caproic acid, whereby the characteristics of the polyester may be controlled independently of the degree of condensation of the constituents from which it is formed. Furthermore, there may also optionally be included polybasic acids such as are well known for use in the manufacture of polyesters or alkyd resins, for example succinic acid, glutaric acid, adipic acid, suberic acid, azelaic acid, phthalic acid, terephthalic acid, maleic acid, fumaric acid, itaconic acid, trimellitic acid or pyromellitic acid (or the corresponding anhydrides where applicable).

The polyesters may be produced by reacting together the constituents described above under the conditions which are conventional for the preparation of such condensation polymers. Typically, the constituents are heated together at a temperature of from 180° to 260° C., if desired in the presence of a solvent and optionally also in the presence of an esterification catalyst such as zirconium octoate or tetrabutyl titanate, until the acid value has fallen to the desired level.

If desired, the polyesters may be wholly or partially neutralised after their preparation by treatment with one or more organic bases, such as dimethylethanolamine or triethanolamine. In this way, all or part of the residual carboxyl groups in the polyester may be converted to amine salt groups. Inorganic bases also can be used to effect neutralisation, but organic bases are preferred.

In carrying out the method according to the invention, the emulsion which is to be demulsified is brought into contact with the polyester by intimate admixture of the latter with the emulsion. For this purpose the polyester may conveniently be carried in solution in a suitable organic solvent liquid or in the same oil as that which constitutes the oil phase of the emulsion which is to be treated.

The proportion of the polyester which is used is suitably in the range 1–500 parts per million by weight of the emulsion being treated, preferably 5–100 parts per million.

After intimately mixing the polyester, or solution thereof, with the emulsion, for example by mechanical agitation, the treated liquid is allowed to stand until the aqueous and oil phases have separated to an acceptable degree.

Water-in-oil emulsions which may be treated by the method of the invention include in particular the emulsions of water in crude oil which are frequently encountered at a production well-head. The water may be naturally present in the oil rising from the well or it may be introduced into the oil as a consequence of the recovery process. The water may in many cases contain dissolved salts, for example sodium chloride, or other substances without interfering with the subsequent demulsification; the method of the invention is thus not limited to the treatment of those emulsions in which the disperse phase consists solely of water. The method is applicable to emulsions in which the continuous phase consists of other types of oil, for example lubricating or mineral oil. The invention is illustrated but not limited by the following Examples.

EXAMPLE 1

A mixture of 95 parts of dodecenyl succinic anhydride, 52 parts of polyethyleneglycol of molecular weight 400, 14 parts of glycerol and 15 parts of xylene was heated at 220° C. in a flask fitted with an agitator, a thermometer, a gas inlet for the purpose of maintaining an atmosphere of nitrogen in the flask, a condenser and a Dean & Stark separator. Reaction was continued until the resulting material had an acid value of 25 mg KOH/g; the solids content was 91.3%. The polyester so obtained was neutralised by the addition of triethanolamine in the proportion of 5.5 parts for every 94.3 parts of polymer solids.

An emulsion was prepared of 10 parts of 3.5% aqueous sodium chloride solution in 90 parts of Iranian Heavy crude oil, using a Silverson high smear emulsifier. To 100 parts of this emulsion were added 10 p.p.m. of the above neutralised polyester, as a 10% solution in 'Aromasol H' (an aromatic solvent consisting essentially of trimethyl benzenes; 'Aromasol' is a Registered Trade Mark). After gentle mixing in of the neutralised polyester solution, portions of the thus treated emulsion were allowed to stand at (i) 20° C. and (ii) 74° C. After a period of 24 hours, 60% of the water in the emulsion had separated in (i); 90% of the water had separated in (ii), whereas under the same conditions the untreated emulsion showed zero and 15% water separation respectively.

EXAMPLE 2

A mixture of 125 parts of dodecenyl succinic anhydride, 90 parts of polyethyleneglycol of molecular weight 400, 15 parts of glycerol and 15 parts of xylene was heated at 212° C. in the manner described in Example 1. The resulting polymer had an acid value of 35.9 mg KOH/g and a viscosity of 57 secs. Body Tube (at 25° C. at a concentration of 93% in xylene). To 95 parts of this polymer were added to 5 parts of dimethylethanolamine and the solution was diluted to 10% concentration with the aromatic solvent described in Example 1 ('Aromasol H'). Following the procedure of Example 1, 10 p.p.m. of this neutralised polyester were introduced, at this 10% solution, into a similar saline emulsion in Iranian Heavy crude oil at (i) 40° C. and (ii) 74° C. After 24 hours 50% of the water had separated from the emulsion in (i) and 90% in (ii); the untreated emulsion again showed zero and 15% water separation respectively.

EXAMPLE 3

A mixture of 770 parts of dodecenyl succinic anhydride, 165 parts of polyethylene glycol of molecular weight 400, 16.6 parts of polyethylene glycol of molecular weight 200, 103.2 parts of glycerol and 60 parts of xylene was reacted at 220° C. as described in Example 1. The reaction was stopped at an acid value of 24.3 mg KOH/g. and the polymer solution thus obtained was thinned to 75% concentration with the aromatic solvent described in Example 1 ('Aromasol H'). To 96 parts of this solution were added 4 parts of dimethylethanolamine and the solution was further reduced to 10% concentration by addition of more of the aromatic solvent. Using a Silverson emulsifier as described in Example 1, this 10% solution was then added to an emulsion of 10 parts of 3.5% sodium chloride solution in 90 parts of Kuwait Crude Oil, so as to produce a concentration of the neutralised polyester of 10 p.p.m. After standing for 24 hours at (i) 43° C. and (ii) 74° C., 60% of the water had separated in (i) and 70% in (ii); under the same conditions, samples of the untreated emulsion lost 10% and 15% of their water content, respectively.

EXAMPLE 4

A mixture of 283 parts of octadecenyl succinic anhydride, 139 parts of polyethyleneglycol of molecular weight 400, 28 parts of glycerol and 25 parts of xylene was reacted at 220° C. as described in Example 1. The final polymer characteristics were: acid value, 22.4 mg KOH/g, viscosity 24 secs Body Tube (at 25° C. at 75% solids in xylene). A portion of this polymer solution was reduced to 10% solids with the aromatic solvent of Example 1 ('Aromasol H') and this 10% solution was then added, so as to give a concentration of the unneutralised polymer of 10 ppm, to an emulsion of 10 parts of 3.5% sodium chloride solution in 90 parts of Kuwait Crude Oil, made as described in Example 1. After standing for 24 hours at (i) 20° C. and (ii) 43° C., 50% of the water had separated in (i) and 70% in (ii). Samples of the untreated emulsion gave 5% and 15% water break, respectively.

EXAMPLE 5

A mixture of 292.3 parts of dodecenyl succinic anhydride, 131 parts of polyethyleneglycol of molecular weight 200, 26.7 parts of glycerol and 25 parts of xylene was reacted at 220° C. as described in Example 1. The derived polymer had an acid value of 21.75 mg KOH/g and a viscosity of 14.5 secs. Body Tube (at 25° C. at 75% solids in xylene). To 97 parts of this polymer solution were added 3 parts of dimethylethanolamine and the blend was reduced to 10% solids by addition of the aromatic solvent of Example 1 ('Aromasol H'). When tested in the same emulsion and at the same concentration in the manner described in Example 4, the proportion of water separation was (i) 60% and (ii) 75%.

EXAMPLE 6

A mixture of 295 parts of dodecenyl succinic anhydride, 90 parts of polyethylene glycol of molecular weight 400, 40 parts of polyethylene glycol of molecular weight 200, 41.5 parts of glycerol and 30 parts of xylene was reacted at 204° C. as described in Example 1. The polymer so prepared had an acid value of 19.4 mg KOH/g and a viscosity of 22 secs. Body Tube (at 25° C. at 75% solids in xylene). Neutralisation of 96 parts of this polymer was effected by adding 4 parts of dimethylethanolamine and the solids content was reduced to 10% by addition of the aromatic solvent of Example 1 ('Aromasol H'). An emulsion of 10 parts of a 3.5% sodium chloride solution in 90 parts of Iranian Heavy Crude Oil was prepared as described in Example 1. A concentration of 10 p.p.m. of the polymer was added, as the 10% solution, to portions of the emulsion which were allowed to stand at (i) 20° C. and (ii) 43° C. In (i), 60% of the water separated after 24 hours and in (ii) 65% separated. No water separated from the untreated emulsion at 20° C. in 24 hours, and only 5% at 43° C. in that period.

EXAMPLE 7

A mixture of 303 parts of dodecenyl succinic anhydride, 113 parts of polyethylene glycol of molecular weight 200, 35 parts of glycerol and 40 parts of xylene was reacted at 200° C. as described in Example 1. The resultant polymer had an acid value of 25.3 mg KOH/g and a viscosity of 14 secs. Body Tube (at 25° C. at 75% solids in xylene). Neutralisation was effected by adding 4 parts of diethanolamine to 96 parts of the polymer and the mixture was then reduced to 10% solids with the aromatic solvent of Example 7 ('Aromasol H'). An emulsion of 10 parts of 3.5% sodium chloride solution in Kuwait Crude Oil was prepared as described in Example 1, and portions of this were treated with 10 p.p.m. of the polymer, added as the aforementioned 10% solution, being subsequently allowed to stand at (i) 20° C. and (ii) 43° C. In each case, 60% of the water separated in 24 hours, whereas the untreated emulsion showed water breaks of only (i) 5% and (ii) 15%

What we claim is:

1. A method for the demulsification of a water-in-oil emulsion which comprises contacting the emulsion with a polyester obtained by the condensation of:

(A) an alk(en)yl succinic anhydride of the formula

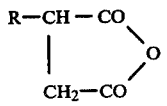

where R is an alkyl or alkenyl radical containing from 9 to 18 carbon atoms;

(B) a polyalkylene glycol which has an average molecular weight of less than 500 and is soluble in water to the extent of at least 5% by weight at 25° C.;

(C) a polyhydric alcohol having three or more hydroxyl groups capable of reacting with the anhydride (A); the polyester so obtained containing 20–40% by weight of residues of the polyalkylene glycol (B) and at least 1% by weight of residues of the polyhydric alcohol (C).

2. A method as claimed in claim 1, wherein the alk(en)yl succinic anhydride is dodecenylsuccinic anhydride.

3. A method as claimed in claim 1 or claim 2, wherein the polyalkylene glycol is a polyethylene glycol of average molecular weight less than 500.

4. A method as claimed in claim 1 or claim 2, wherein the polyhydric alcohol is glycerol.

5. A method as claimed in claim 1 or claim 2 wherein the polyester has an acid value of less than 50 mg KOH/g.

6. A method as claimed in claim 5, wherein the polyester has an acid value of less than 25 mg KOH/g.

7. A method as claimed in claim 1 or claim 2, wherein the polyester has a viscosity of at least 2 poise when measured at 25° C. as a 75% solids solution in xylene.

8. A method as claimed in claim 1 or claim 2, wherein the polyester is obtained by the condensation of constituents (A), (B) and (C) as hereinabove defined and in addition a monobasic fatty acid.

9. A method as claimed in claim 1 or claim 2, wherein the polyester is obtained by the condensation of constituents (A), (B) and (C) as hereinabove defined and in addition a polybasic acid.

10. A method as claimed in claim 1 or claim 2, wherein the residual carboxyl groups in the polyester are wholly or partially converted to amine salt groups by treatment of the polyester after its preparation with an organic amine.

11. A method as claimed in claim 1 or claim 2, wherein the proportion of the polyester which is used is in the range 5–100 parts per million by weight of the emulsion being treated.

* * * * *